US007153236B2

(12) United States Patent
Gershman

(10) Patent No.: US 7,153,236 B2
(45) Date of Patent: Dec. 26, 2006

(54) MUSCLE EXERCISER AND TONER DEVICE WITH MICROPROCESSOR CONTROLLED MULTIPLE WORKOUTS

(76) Inventor: Vladimir Gershman, 3476 Coventry Pl., Holland, PA (US) 18966

( * ) Notice: Subject to any disclaimer, the term of this patent is extended or adjusted under 35 U.S.C. 154(b) by 561 days.

(21) Appl. No.: 10/724,489

(22) Filed: Dec. 1, 2003

(65) Prior Publication Data

US 2005/0130801 A1 Jun. 16, 2005

(51) Int. Cl.
*A63B 21/00* (2006.01)
*A06N 1/00* (2006.01)

(52) U.S. Cl. ..... 482/1; 601/46; 482/8

(58) Field of Classification Search ..... 482/1–9, 482/900–902; 601/46, 48–54, 56–63
See application file for complete search history.

(56) References Cited

U.S. PATENT DOCUMENTS 1,936,022 A * 11/1933 Hunt ..... 601/110
5,913,836 A * 6/1999 Groux ..... 601/21
6,626,890 B1 * 9/2003 Nguyen et al. ..... 604/542

* cited by examiner

*Primary Examiner*—Glenn E. Richman

(57) ABSTRACT

The muscle exerciser and toner device with microprocessor controlled multiple workouts, produces specially timed vibrations to exercise muscles and burn body fat without a need to perform an actual physical exercise. The device can be attached to different parts of the human body and thru vibrations make the muscles contract and extend. This is equivalent to a process of a genuine exercise session. A motor generates vibration with an eccentric weight mounted on a shaft. The motor is controlled by a microprocessor, which runs a specifically timed workout program consisting of exercise and rest cycles. After the workout is over the device shuts off automatically. The device operation is simple and requires pressing one button. The timing of the workout program is similar to that of a real exercise session, thus enabling the device to emulate a genuine physical workout. Several devices can be placed on various muscles simultaneously.

13 Claims, 2 Drawing Sheets

MUSCLE EXERCISER AND TONER DEVICE WITH MICROPROCESSOR CONTROLLED MULTIPLE WORKOUTS

CROSS REFERENCE TO RELATED APPLICATIONS

U.S. PATENT DOCUMENTS
U.S. Pat. No. 5,575,761 Nov. 11, 1996 Hajianpur
U.S. Pat. No. 5,857,984 Jan. 01, 1999 deBoer et. Al.
U.S. Pat. No. 6,093,164 Jul. 07, 2000 Davis

BACKGROUND OF THE INVENTION

1. Field of Invention

This invention relates to the field of exercising and weight loss equipment. In particular, it addresses the issue of exercising equipment that can help loose weight and tone muscles of one's body without doing actual physical exercise.

2. Description of Prior Art

Efficiency of an exercise depends on two main parts: intensity and timing. Intensity characterizes how hard one moves muscles to make them grow or burn body fat. Timing is important to allow muscles to rest and work in a cycle that is beneficial and not detrimental to body.

In today's busy life, many people ignore the need to exercise due to lack of time, boredom or health conditions. This triggered appearance of some devices that claim to burn fat without need of actual exercising. One existing device uses electric pulses to stimulate body fat tissues. This does not put any hard strain on muscles, is very inefficient and may have an effect (if any) after a very long time. Only actual physical movement of a muscle will efficiently stimulate fat loss.

Some other devices use vibration (U.S. Pat. Nos. 5,575,761 and 5,857,984), but they are used for therapeutic treatments and lack timing requirements of an efficient exercise as defined above. Their vibration effect is not timed; therefore, the device cannot be used as an efficient exercise device. Other devices use vibration as an alert signal (U.S. Pat. No. 6,093,164).

SUMMARY OF INVENTION

Device in the present invention was designed and built to satisfy the requirements of a real exercise and address deficiencies of the previous designs. The device uses timed mechanical vibrations to make muscles move and thus stimulate body fat burning without having to perform any of the actual physical activities. It uses specially formulated workout timing to achieve the effect of muscle toning and fat burning. Also, the device works with minimal user involvement. One only has to put the devices on one or many body parts, set the workout number and continue doing whatever he or she was doing. The device acts as a warm-up and exercise device. After turning it on, the device automatically runs the workout cycles consisting of vibration and rest periods. After the workout is over the devices shuts off automatically and stays in a standby mode.

BRIEF DESCRIPTION OF THE DRAWINGS

The preferred embodiment and electronic design of the invention, which illustrates all its features is shown in the figures below. The figures demonstrate the novelty of the invention and are for illustrative purposes only. The drawings include the following figures (Figs.) with like numerals indicating the like parts.

DETAILED DESCRIPTION OF THE INVENTION

Introduction

The device uses specially timed vibrations to exercise muscles and burn body fat without a need to perform an actual physical exercise.

Figure 1:
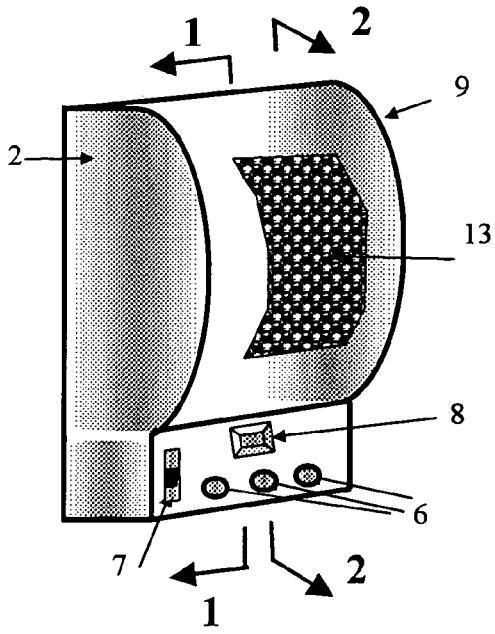
FIG. 1 is simplified perspective or isometric view of the device depicting its indicators and controls.
Figure 2:
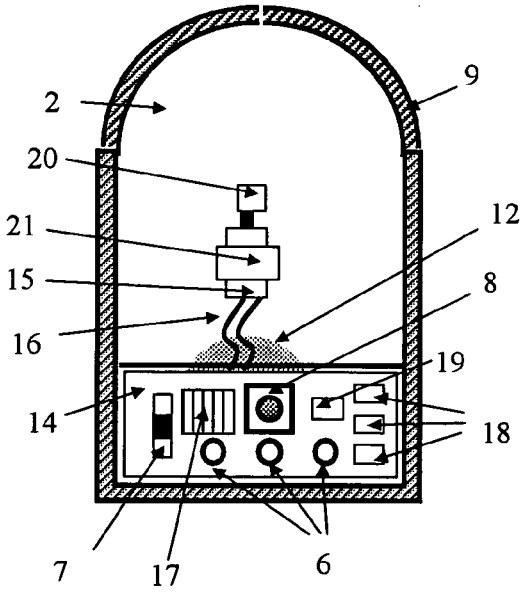
FIG. 2 is a cross sectional assembly view taken along line 1—1 of FIG. of the device.
Figure 3:
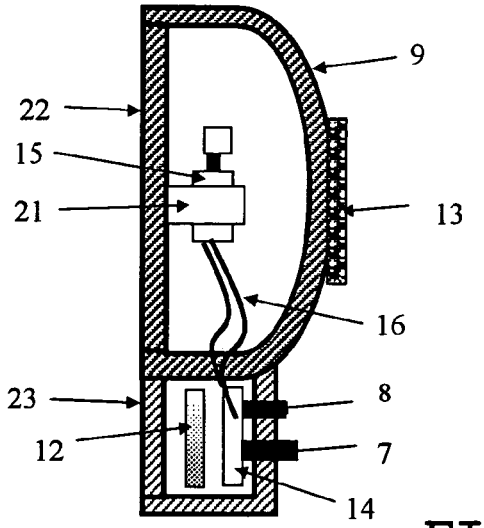
FIG. 3 is a cross sectional assembly view taken along line 2—2 of the device.

As shown in FIGS. 1, 2 and 3, the device module 9 is contained within a plastic enclosure 2. It has an ON/OFF switch 7, which applies or cuts off power from a battery 12 to the device. A regular coin cell type battery can be used. Sliding switch 7 to ON position turns on the device 9 and starts Workout level No. 1. The workout levels are described later in the text. Once the device 9 is turned on, the vibration begins and the first of three Light Emitting Diodes (LEDs) 6 lights up. Pressing the pushbutton 8 once will change the operation to Workout level No. 2 and two LEDs 6 will light up. Pressing the pushbutton 8 twice will switch the device 9 to Workout level No. 3 and all three LEDs 6 will light up. Pressing the pushbutton 8 a third time will switch back to Workout level No. 1 and the cycle repeats. After the workout is completed the device 9 goes into a SLEEP mode. In SLEEP mode, all three LEDs 6 and the vibration process are turned off. During the SLEEP mode, the device 9 consumes 0.5 microamperes of current. This extends battery life and eliminates the need for the user to turn the device OFF. The device is turned back on to Workout level No. 1 when the user presses the pushbutton 8 once while the device is in SLEEP mode. Also, the user can slide the switch 7 to the OFF position and then ON again to resume workout.

Figure 4:
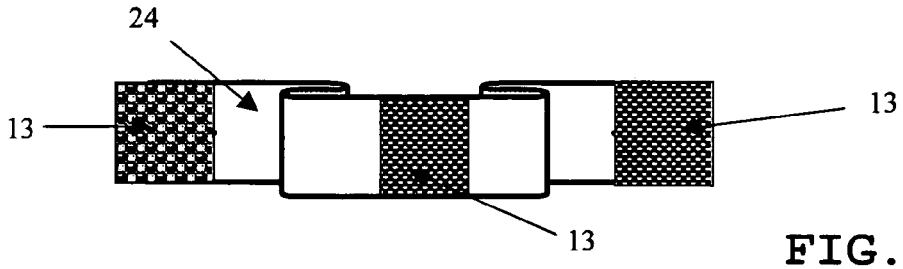
FIG. 4 is a simplified perspective or isometric view of a belt used to wear the device.
Figure 5:
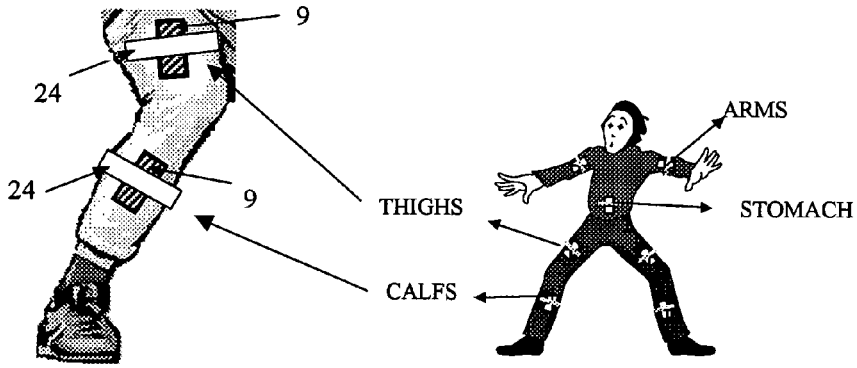
FIG. 5 is a simplified perspective or isometric view of locations where the device can be worn. Plurality of identical devices are illustrated one of which has an exploded view.
Figure 6:
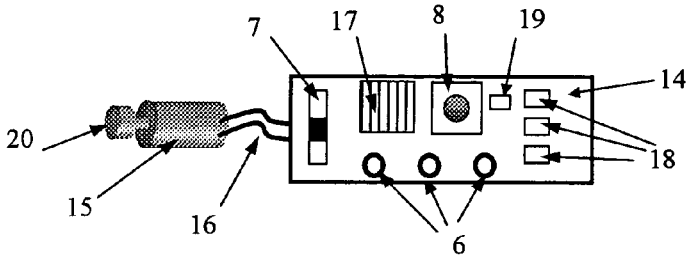
FIG. 6 is an electronic assembly diagram, which depicts placement of electronic components and a motor.

The device 9 attaches to a belt 24 with a Velcro material 13. The belt 24 is made out of an elastic material, which is shown in FIG. 4. The belt 24 has Velcro strips 13 on it to allow adjustment for the different sizes of people. The device 9 attaches to the belt 24 with a Velcro strip 13, which is glued to the body 2 of the device 9. The device 9 can be placed on different muscles of the body: arms, thighs, stomach and calves as shown in FIG. 5. The user wraps the belt 24 around the body part he wants to exercise. The device 9 module works an area of 3–5" in diameter.

The construction of the device module is shown in FIGS. 1, 2 and 3. The motor 15 and Printed Circuit Board (PCB) 14 are mounted in the plastic enclosure 2. The motor 15 is connected to the PCB 14 using two wires 16. The PCB 14 contains a microprocessor 17, a capacitor 19, three LEDs 6, a pushbutton switch 8, a slide switch 7 and three resistors 18.

The motor 15 has an eccentric weight 20 on its shaft that causes it to vibrate during operation. The motor 15 is mounted in a plastic holder 21, which is a part of the cover plate 22. Cover plate 22 closes the vibration cavity of the device 9. Cover plate 23 closes the area of the device 9 where the battery 12 resides.

Figure 7:
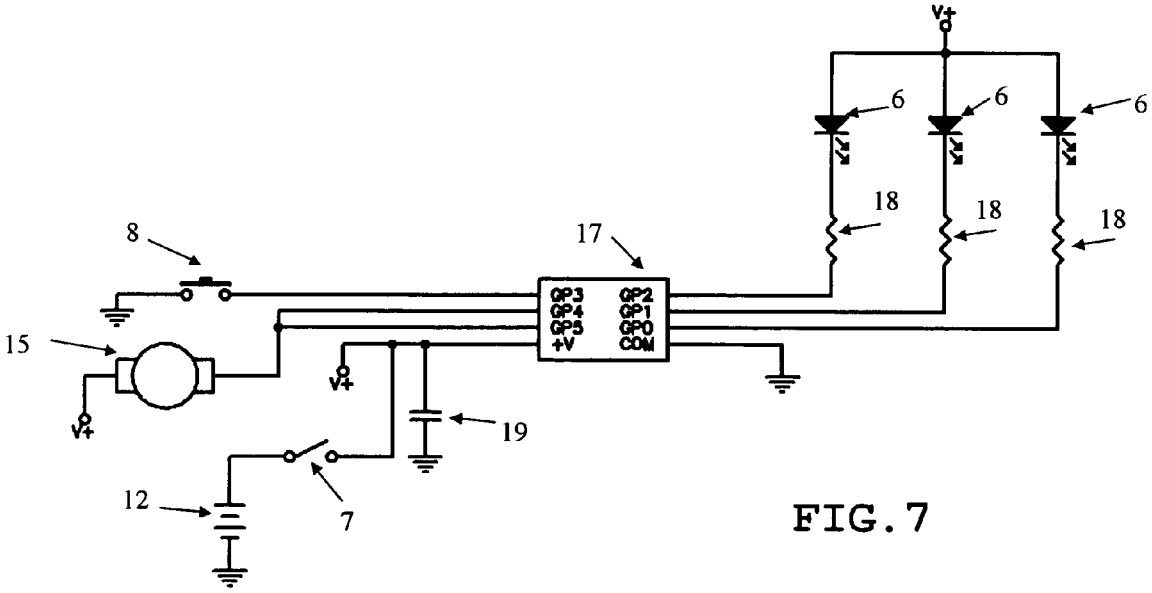
FIG. 7 is an electronic circuit schematic diagram of the device.

The electronic circuit shown in FIG. 7 operates as follows: A battery 12 (VB) supplies power to the circuit by closing the slide switch 7 (S1). The microprocessor 17 (U1) reads a voltage from the pushbutton switch 8(S2) and controls when the motor 15(M1) and LEDs 6 (D1, D2, D3) turn on and off. Pressing down pushbutton switch 8(S2) changes the timing operation of the motor 15(M1) and LEDs 6(D1, D2, D3). The capacitor 19(C1) is used to stabilize and filter the microprocessor 17(U1) voltage. Resistors 18 (R2, R3, and R4) are used to limit current in LEDs 6(D1, D2, D3) to prolong battery life. Microprocessor 17 runs a program that follows a special algorithm designed to provide a maximum efficiency workout. Also, the microprocessor 17 puts the device 9 into SLEEP mode and turns off the motor 15 and LEDs 6. The program uses the microprocessor's 17 internal oscillator and pull-up resistors to reduce component and assembly cost. In addition, the program uses microprocessor's 17 SLEEP mode to put it in a standby state and prolong battery 12 life.

The timing of the three workout levels, pre-programmed in the microprocessor, are analogous to those of standard workouts. The timing has been selected based on exercise literature and consultation of personal trainers, physical therapists and physicians. The workouts are set up as follows:

Workout No. 1: Single set intensity; 6 cycles of motor on for 1 minute (equivalent to 10–12 reps per set), then motor off for 1 minute (rest)

Workout No. 2: Superset set intensity; 4 cycles of motor on for 3 minute (equivalent to 10–12 reps per set), then motor off for 1 minute (rest).

Workout No. 3: Triset set intensity; 3 cycles of motor on for 4 minute (equivalent to 30–36 reps per set), then motor off for 1 minute (rest)

The computer program was written using MPASM assembler language available from Microchip Technology Inc. The microprocessor 17 used was PIC12C508 series. Brief operation of a program is as follows: The program starts with microprocessor OPTIONS set to "wake up" on signal change in pin GP3, enable weak pull-ups and use the prescaler for timer module. Initially, the microprocessor is in SLEEP mode. If switch 7 slides to position ON or a pushbutton 8 is pressed down, this causes the microprocessor 17 to wake up and activate Workout level No. 1 with a preset ON/OFF timing for the motor 15. The microprocessor 17 counts how many times pushbutton 8 has been pressed. The first pressing changes timing to Workout No. 2 timing, the second pressing changes to Workout No. 3 timing and the third pressing changes to back to Workout No. 1. After the workout is over, the microprocessor 17 goes back to SLEEP mode. The program uses a 50 second delay subroutine and a macro to count number of pressings of the pushbutton 8.

ASSEMBLY LANGUAGE SOURCE CODE FOR MICROPROCESSOR PROGRAM

```
    LIST P=12C508A
    include "P12C508A.INC"
; filename : 12c509a5.asm
; define CONFIG WORD
; bit 1–0 :                10      - for internal RC oscil
; bit 2                    :       0          - WDT disabled
; bit 3                    :       1          - code prot OFF
; bit 4                    :       0          - MCLR disabled, tied to VDD internally
; bit 11–5 :               1111111 - don't care - make all 1'S
; The word is : 1111 1110 1010 = FEA
        ___CONFIG 0xFEA
;================== NOTES ================================
; Delay = TEMP1×TEMP2×TEMP3×TEMP4×Tcycle*3
; if TEMP1,2,3 = 255, Delay ~= 50 sec
; Operation
;           after power is turned on, start a cycle:
;                - motor ON for MINUTES_ON min
;                - motor off for MINUTES_OFF min
;                - motor OFF till power is re-applied
;                - PIC goes to SLEEP after the cycle ends
;                - MINUTES_ON will very depending on a REGIME set up
;                - each REGIME turns on LED(s)
;MOTOR, LED ON condition: Level = LOW (0), TRIS = output (0)
;MOTOR, LED OFF condition: Level = HI (1), TRIS = output (1)
;
; REGIME pin (GP3) is pulled up HI
;           whenever it goes LOW (press a button)
;           REG_COUNT is decremented, if it is zero, set REG_COUNT
;           to 3 again
;vvvvvvvvvvvvvvv variables vvvvvvvvvvvvvvvvvvvv
TEMP1               equ         0x07      ;Temp variables for DELAY sub
TEMP2               equ         0x08
TEMP3               equ         0x09
MINUTES_ON          equ 0x0a
MINUTES_OFF         equ 0x0b
ON_CYCLES_CNT equ 0x0c
REG_COUNT           equ 0x0d    ; count how many times push. button pressed
```

-continued

ASSEMBLY LANGUAGE SOURCE CODE FOR MICROPROCESSOR PROGRAM

```
TRIS_MOT_ON        equ 0x0e    ; variable common to all modes, motor ON
TRIS_MOT_OFF       equ 0x0f    ; variable common to all modes, motor OFF
MIN_ON_CNT         equ 0x10    ; current minute ON count
MIN_OFF_CNT        equ 0x11    ; current minute OFF count
;cccccccccccccccccccc constants cccccccccccccccc
;--- mask to control output level ---------
; GP0 - LED1
; GP1 - LED2
; GP2 - LED3
; GP3 - REGIME (since GP3 is input only)
; GP4 - MOT1
; GP5 - MOT2
;#define DEBUG
#ifdef DEBUG
#define DELAY_ALL 0x01
#else
#define DELAY_ALL 0xff
#endif
;
; MASKS FOR LEVELS AND TRIS ARE THE SAME SINCE
;          ACTIVE LEVEL IS LOW AND SO IS THE TRIS FOR OUTPUT
; "ON" MASKS, REG_COUNT(GP5) IS ALWAYS INPUT
#define LED1_M_ON          b'00001110'          ;GP4,5 - motor ON, GP0 = ON
#define LED12_M_ON         b'00001100'          ;GP4,5 - motor ON, GP0,1 = ON
#define LED123_M_ON        b'00001000'          ;GP4,5 - motor ON, GP0,1,2 = ON
;
; "OFF" MASKS - ONLY MOTOR OFF, LEDs STAY ON DEPENDING ON REGIME
#define LED1_M_OFF         b'00111110'          ;GP4,5 - motor OFF, GP0 =LED1 ON
#define LED12_M_OFF        b'00111100'          ;GP4,5 - motor OFF, GP0,1 = ON
#define LED123_M_OFF b'00111000'        ;GP4,5 - motor OFF, GP0,1,2 = ON
;
; ---- REGIME CONSTANTS --------------------
#define MINUTES_ON_1             2       ; 1 ALWAYS set to 1 more then needed
#define MINUTES_OFF_1            2       ; 1
#define ON_CYCLES_CNT_17         ; 6
#define MINUTES_ON_2             4       ; 3
#define MINUTES_OFF_2            2       ; 1
#define ON_CYCLES_CNT_25         ; 4
#define MINUTES_ON_3             5       ; 4
#define MINUTES_OFF_3            2       ; 1
#define ON_CYCLES_CNT_34         ; 3
#define REGIME                           3            ; pin 3, pulled up HI thru OPTION
#define SET_OPTION         b'00000111'
                                                          ;bit 2–0:111 - prescaler 1:128
                                                          ;bit 3:0 - use prescaler for TMR0
                                                          ;bit 4:0 - incr on HI to LO
                                                          ;bit 5:0 - trans. on Internal clk
                                                          ;bit 6:0 - ENable weak pullup
                                                          ;bit 7:0 - ENable wake up on change
;mmmmmmmmmmmm Start MACRO definitions mmmmmmmmmmmmmmmmmmmmmmm
;*************************************************
; This mac sub polls GP3 for change in level from 0 to 1.
; If the level did change, then decrement REG_COUNT,
; load appropriate LEDs and TRIS, and change timing
; intervals for REG_COUNT
;*************************************************
check_reg_mac      macro
                   ;movf GPIO,W                 ; read port
                   btfsc GPIO, REGIME           ; test if the pin went low (may need debounce)
                   goto DLOOP_CONT                        ; continue with delay sub
                   clrf TMR0
debounce
                   comf TMR0,    W              ; check if TMR0 expired
                   btfsc    STATUS, Z           ;
                   goto check_again        ; if TMR0 expired check level again
                   goto debounce                ; else keep on incr TMR0
check_again
                   btfsc GPIO, REGIME           ; after TMR0 full, check pin again
                   goto DLOOP_CONT                        ; if back to HI con. old regime
                   movf REG_COUNT, W            ; get curret count value
                   xorlw 3                                ; test for count = 3
                   btfss STATUS, Z              ; count = 3
                   goto Chk2_Reg
                   decf REG_COUNT,F             ; count = 2, LED1,2
                   movlw    MINUTES_ON_2
                   movwf    MINUTES_ON
                   movwf    MIN_ON_CNT
```

-continued

ASSEMBLY LANGUAGE SOURCE CODE FOR MICROPROCESSOR PROGRAM

```
                    movlw    MINUTES__OFF__2
                    movwf    MINUTES__OFF
                    movwf    MIN__OFF__CNT
                    movlw    ON__CYCLES__CNT__2
                    movwf    ON__CYCLES__CNT
                    movlw LED12__M__ON          ; new REGIME will always start ON
                    movwf TRIS__MOT__ON
                    movwf GPIO
                    tris GPIO
                    retlw 0x0f
Chk2__Reg
                    movf REG__COUNT,W           ; get curret count value
                    xorlw 2                                  ; test for count = 2
                    btfss STATUS,Z              ; count = 2
                    goto Chk1__Reg
                    decf REG__COUNT             ;count = 1, LED1,2,3
                    movlw    MINUTES__ON__3
                    movwf    MINUTES__ON
                    movwf    MIN__ON__CNT
                    movlw    MINUTES__OFF__3
                    movwf    MINUTES__OFF
                    movwf    MIN__OFF__CNT
                    movlw    ON__CYCLES__CNT__3
                    movwf    ON__CYCLES__CNT
                    movlw LED123__M__ON  ; new REGIME will always start ON
                    movwf TRIS__MOT__ON
                    movwf GPIO
                    tris GPIO
                    retlw 0x0f
Chk1__Reg
                    movlw    3                                ; set count to 3 again
                    movwf    REG__COUNT
                    movlw    MINUTES__ON__1
                    movwf    MINUTES__ON
                    movwf    MIN__ON__CNT
                    movlw    MINUTES__OFF__1
                    movwf    MINUTES__OFF
                    movwf    MIN__OFF__CNT
                    movlw    ON__CYCLES__CNT__1
                    movwf    ON__CYCLES__CNT
                    movlw LED1__M__ON           ; new REGIME will always start ON
                    movwf TRIS__MOT__ON
                    movwf GPIO
                    tris GPIO
                    retlw    0x0f                             ; if 0x0f upon return, exit delay
                    endm
;*************** end check__reg__mac *****************
;mmmmmmmmmmmmmmm End MACRO def mmmmmmmmmmmmmmmmmmmmmmmmmmmmmmmmmmmm
;************ START program ******************
                    org   0x00                  ;Effective Reset Vector
                    movlw SET__OPTION
                    OPTION
                    btfsc STATUS, GPWUF
                    goto START
                    goto TO__SLEEP
TO__SLEEP
                    sleep
                    nop
START
                    movlw SET__OPTION
                    OPTION
                    movlw 0xff
                    movwf    GPIO          ; set outputs to HI to turn OFF
                    tris GPIO              ; turn OFF output/MOTOR
                    movlw    3                  ; one more than should be
                    movwf REG__COUNT
                    ;set REGIME__1
                    movlw    MINUTES__ON__1
                    movwf    MIN__ON__CNT
                    movwf    MINUTES__ON
                    movlw    MINUTES__OFF__1
                    movwf    MIN__OFF__CNT
                    movwf    MINUTES__OFF
                    movlw    ON__CYCLES__CNT__1
                    movwf    ON__CYCLES__CNT
```

-continued

ASSEMBLY LANGUAGE SOURCE CODE FOR MICROPROCESSOR PROGRAM

```
                movlw LED1_M_OFF                    ; initialize for OFF mode
                movwf   TRIS_MOT_OFF      ; always one LED on and motor off for 1 min
                movlw LED1_M_ON
                movwf TRIS_MOT_ON
                movwf GPIO
                tris GPIO          ; W still has the MASK
LOOP_ON             nop
                decfsz   MIN_ON_CNT,F    ; keep on running MINUTES_ON
                goto KEEP_ON
                goto TURN_OFF
KEEP_ON         nop
                call delay
                goto LOOP_ON
TURN_OFF        nop
                        movf TRIS_MOT_OFF,W
                        movwf GPIO        ; set outputs to HI to turn OFF
                        tris GPIO         ; turn off output/MOTOR
                        movf          MINUTES_ON, W     ;reset ON count
                        movwf         MIN_ON_CNT
                        decfsz        ON_CYCLES_CNT, F
                        goto KEEP_OFF
                        goto DONE
KEEP_OFF        nop
                        decfsz        MIN_OFF_CNT,F
                        goto LOOP_OFF
                        goto TURN_ON
LOOP_OFF        nop
                        call delay
                        xorlw 0x0f        ;check if return was 0 or 0x0f
                        btfsc STATUS, Z   ; if it was 0x0f restart loop
                        goto LOOP_ON
                        goto KEEP_OFF
TURN_ON         nop
                        movf TRIS_MOT_ON,W
                        movwf GPIO        ; set outputs to HI to turn OFF
                        tris GPIO         ; turn off output/MOTOR
                        movf   MINUTES_OFF,W        ; reset OFF count
                        movwf   MIN_OFF_CNT
                        goto LOOP_ON
DONE            movlw 0xff
                        movwf GPIO        ; set outputs to HI to turn OFF
                        tris GPIO         ; turn OFF output/MOTOR
                        goto TO_SLEEP
;*************************************
;* This routine is a software delay. *
;* Fosc = 1/Tosc; Tcycle = 4 × Tosc *
;* Delay = TEMP1×TEMP2×TEMP3×Tcycle*3 ~= 50 sec *
;*************************************
delay
            movlw DELAY_ALL             ; in final use 0xFF
            movwf TEMP1                 ;TEMP1 = 255
            movwf TEMP2                 ;TEMP2 = 255
            movwf TEMP3                 ;TEMP3 = 255
DLOOP
            decfsz TEMP1, F
            goto DLOOP
            decfsz TEMP2, F
            goto DLOOP
            check_reg_mac          ;check regime macro
DLOOP_CONT
            decfsz TEMP3, F
            goto DLOOP
            retlw 0
;**********************end delay sub******************
            end
```

What I claim as my invention is:

1. A portable exercising device that uses specially timed vibrations applied to the human body in order to promote the burning of body fat and the toning of muscles and said device comprising:

A microprocessor that controls timing cycles of mechanical vibrations delivered to the human body;

A computer program executing on said microprocessor and implementing algorithm that sets said timing cycles to achieve an efficient physical workout;

A motor energized and de-energized by said microprocessor with said motor comprising an eccentric weight mounted on a shaft of said motor to produce said mechanical vibrations;

A printed circuit board comprising said microprocessor, three light emitting diodes, three resistors, one capacitor, one slide switch, one pushbutton switch and two electric wires;

A housing transferring said mechanical vibrations to human body and enclosing said printed circuit board, said motor and a Lithium coin cell battery.

2. The exercising device of claim 1 uses a microprocessor to control motor generated vibrations timed in such a way, as to make muscles of the body part being execised, to work and relax in a manner that promotes muscle toning and body fat burning.

3. The exercising device in claim 1 employs specially designed workout timing, that facilitates weight loss and muscle toning and implements said workout timing by means of said computer program running on said microprocessor.

4. The exercising device of claim 1, wherein said computer program implements an algorithm that sets said workout timing cycles and said program executes on said microprocessor and controls timing of said mechanical motor vibrations to promote efficient muscle workout and fat burning.

5. The exercising device of claim 1, wherein light emitting diodes controlled by microprocessor in claim 1 give visual indication to a user as to which workout is being used.

6. The exercising device of claim 1, wherein said device once turned on operates autonomously and runs the workout timing automatically without need for further user intervention.

7. The exercising device of claim 1, wherein said microprocessor and said computer program turn off motor and light emitting diodes automatically without need for a user intervention.

8. The exercising device of claim 1, wherein timed vibrations of said device allow it to be used as a warm up device before a regular physical exercise.

9. The exercising device of claim 1 using said microprocessor and said computer program allow a single pushbutton operation wherein pressing said pushbutton toggles change from one workout to another.

10. The exercising device of claim 1, wherein said motor vibrates at frequencies ranging from 90 to 100 Hz.

11. The exercising device of claim 1, wherein said housing has a shape that allows efficient transfer of said mechanical vibrations to human body.

12. The exercising device of claim 1, wherein said device upon completion of said workout goes into standby (sleep) mode and in said mode consumes 0.5 microamperes of current.

13. The exercising device of claim 1, wherein said microprocessor uses two "wired OR" outputs to energize said motor when said outputs sink current thru said motor.

* * * * *